United States Patent [19]

Frank

[11] 4,175,393

[45] Nov. 27, 1979

[54] ROTARY VANE DRIVE WITH ROTATING CYLINDER

[76] Inventor: Engelbert Frank, Bahnhofstrasse 26/28, 6461 Hasselroth 1, Fed. Rep. of Germany

[21] Appl. No.: 872,936

[22] Filed: Jan. 27, 1978

[30] Foreign Application Priority Data

Feb. 2, 1977 [DE] Fed. Rep. of Germany ..... 2704151

[51] Int. Cl.[2] ..... F01K 25/00; F01C 1/00; F01C 13/02

[52] U.S. Cl. ..... 60/671; 418/173; 418/236; 418/268; 418/270

[58] Field of Search ..... 418/173, 236, 238, 268, 418/270; 60/671

[56] References Cited

U.S. PATENT DOCUMENTS

| | | | |
|---|---|---|---|
| 145,505 | 12/1873 | Klein | 418/173 |
| 268,659 | 12/1882 | Gillespie | 418/268 |
| 2,064,635 | 12/1936 | Stern | 418/173 |
| 2,324,903 | 7/1943 | Beckman | 418/173 |
| 3,479,817 | 11/1969 | Minto | 60/671 |
| 3,597,132 | 8/1971 | Stahmer | 418/238 |
| 3,936,252 | 2/1976 | Maher | 418/173 |

*Primary Examiner*—John J. Vrablik
*Attorney, Agent, or Firm*—Dennison, Dennison, Meserole & Pollack

[57] ABSTRACT

A drive apparatus incorporating a rotor rotatably received within the hollow interior of a cylindrical box which is in turn rotatably received within a cylindrical chamber defined within a casing. The rotor is eccentrically positioned within the concentric box and chamber with the rotor including a plurality of selectively extensible and retractable segments for selective engagement with the interior of the cylindrical box upon a rotational driving of the rotor in response to the introduction of pressurized fluid.

8 Claims, 6 Drawing Figures

ROTARY VANE DRIVE WITH ROTATING CYLINDER

The invention relates to a driving machine where an operating means admitted thereto under pressure puts a rotor into rotary motion. Such a machine can be used for many driving purposes, e.g. for all kinds of machine tools but also to drive vehicles. As a pressure means one can use e.g. high pressure gases or steams or compressed air. In the following, the operational field of drive for dental instruments is placed into the foreground without any restricting intentions.

It is known in the art to use turbines as machine tools for dental instruments, by means of which one can obtain rather high speeds at a steady run. For this purpose there are known turbines driven by compressed air and electric drives. Electromotors having a high speed, require some time until they come to a stop. One must wait for this time before a new tool, e.g. a drill of a different size, can be put in. By a frequent change of instruments, the time of treatment will thus be extended in no small measure. The time of slowing down for known drives can be shortened by means of a brake. However, with the brake the expenses for apparatus will increase considerably.

It is therefore the object of this invention to provide a driving machine where an operating means admitted thereto under pressure puts a rotor into rotary motion; by means of which very high speeds can be obtained equalling those of turbines with blade systems, while the slow-down time is being kept as short as possible without requiring any special brake.

According to the invention, this problem is solved in that the cylindric rotor is provided with guide slits accommodating segments slidingly in radial direction, and arranged eccentrically in a hollow cylindric recess of a casing, as well as overhung-mounted in one front wall of the casing with its shaftlike extension, and that in the other front wall of the casing provision is made for an inlet for the operating means and an outlet, of which the openings into the crescent-shaped working space are arranged each on one side at or close to that section where the rotor is coming closest to the inner surface of the recess. This arrangement is of very simple construction and has a high power output at little weight and small dimensions. The above described device does not require any complicated geometric configuration as to the curved blades of turbines. The rotor is put into rotation directly by the operating means. Therefore no connecting rod drives are required. Therefore this machine can be manufactured in a most economical manner.

In addition thereto, the machine runs steadily. Dental instruments or other users of mechanic work can be connected with the shaftlike extension via a coupling. A further advantage of the machine is to be seen in the uncomplicated maintenance of same.

Since the rotor of the machine, after the operating means having been switched off, comes to a standstill in relatively short time, the time spent on the change of the driven instrument is reduced. The driving machine can be used not only for dental instruments but also for other tools. Its application will be very economical in those places where there is already a supply system for the driving means, e.g. a compressed air system.

In a preferred embodiment it is provided that the cylindric rotor together with the segments is arranged within a cylindric box, open at one frontal end toward the front wall of the casing, carried in rotable bearing in the casing and having in its bottom a thru-hole for the shaftlike extension. During rotation the segments, under the influence of the centrifugal forces and of an eventually existing spring prestress, are leaning against the inner surface of the box. Thereby the box is driven by the segments, if necessary, under a slip. This has several advantages. The bedding of the box, e.g. by using roller bearings or a self-lubrication, can be of especially little friction. As the segments must not necessarily glide along the cylindric inner surface anymore, the friction is considerably reduced. In addition thereto, the segments leaning against the inner surface do improve the sealing between the chambers of the crescent-shaped working space. This good sealing is obtained without the use of own packing elements. On the bottom surface of the box and on the frontal side of the casing a sufficiently good packing effect can be achieved by by the selection of small distances to the segments. The efficiency of the driving machine is thus considerably increased by the above explained arrangements.

Preferably the segments at their outer ends each time will be of increased breadth, the outer surface of which being adjusted to the inner radius of the box. Hereby the surfaces of contact between the inner wall of the box and the segments are enlarged. By this arrangement, the sealing between the chambers of the working space partitioned off by the segments, is even more improved. On slowing down after the operating means has been switched off, the outer surfaces of the segments are gliding on the inner surface of the box. The enlarged outer surfaces of the segments produce a higher friction. This adds to a reduction of the slowing down time.

In a preferred embodiment the inlet opening is configured like a nozzle and is inclined in such a manner as to direct the flow of the operating means toward the broadsides of the segments.

By this arrangement the kinetic energy of the operating means is increased. In the driving machine, the kinetic energy as well as the expansion of the operating means are fully utilized for the work output.

In a favorable embodiment it is provided that the cylindric rotor has a recess in front of each segment as viewed in the sense of rotation of the rotor, through which an upper marginal section of the segment becomes freely accessible to the operating means already in its utmost retracted position in the guide slit. By this arrangement the working surfaces for the operating means on the segments are enlarged. At the same time the available volume of the chamber is increased thereby.

Preferably six segments are arranged at equal distances along the cylindric circumference of the rotor. With only a little number of segments, this arrangement makes possible a good utilization of the energy of the admitted operating means. Thus this arrangement is especially economical in manufacture as well as in operation.

In another preferred embodiment the guide slits in the cylindric rotor for the support of the segments at their surfaces facing the inlet and outlet openings, are partially covered by thin walls extending from the bottom of the guide slits to a portion of the height of the slits. The thin walls prevent a displacement of the segments axially against the front side of the casing where the inlet and outlet openings are located. Therefore the segments are at a fixed distance from the front wall which can be rather small. The friction between the segments and the front wall is prevented by this arrangement. On the other hand the segments can touch the bottom of the box. During operation of the driving machine, the box rotates as fast as the segments. Thereby the segments as against the box, are only making short shifting motions in radial direction. These motions do not hamper the working manner. In addition thereto, the thin walls do away with shunts for the operating means that can thus be utilized more effectively for the generation of mechanic work.

It is further preferable to connect at least two adjacent chambers of the working space being enclosed by segments, via two openings or one longitudinal opening, at the same time with the discharge channel. With this arrangement the operating means, e.g. compressed air, is quickly discharged from the inside of the casing. The air can reach the atmosphere through the outlet opening. In this case the expense for mains connecting the machine tool with the power supply network is especially little.

Preferably the guide slits are arranged like tangents in respect to a solid core surrounding the center axis of the rotor. With this arrangement deep guide slits can be obtained without their bottoms approaching the center axis of the rotor too closely. Even when the segments are in maximum traveled-out position, the above arrangement still secures a rather good support and guide. Furthermore high torques can be transmitted to the rotor.

In still another preferred embodiment the inlet channel and the discharge channel are connected with a complete cycle of operating means, whereby a liquid with a low boiling point is used for an operating means, which by the supplying of heat can be changed into the gas phase with increased pressure.

Further details, features and advantages will be apparent upon consideration of the following description of a preferred embodiment in conjunction with the annexed drawings wherein.

Figure 4:
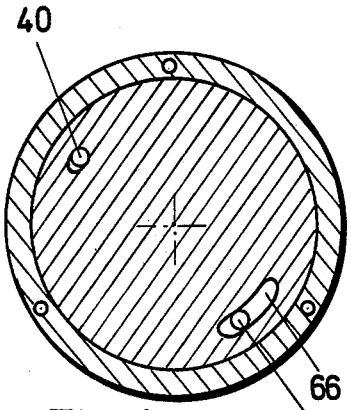
FIG. 4 is a sectional view taken along line IV—IV of FIG. 1.
Figure 1:
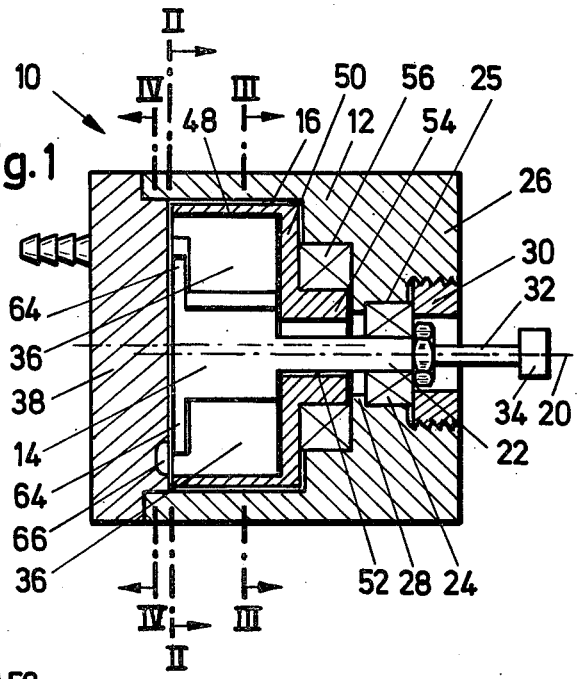
FIG. 1 is a schematic sectional view taken along the longitudinal axis of an embodiment of the new machine.
Figure 2:
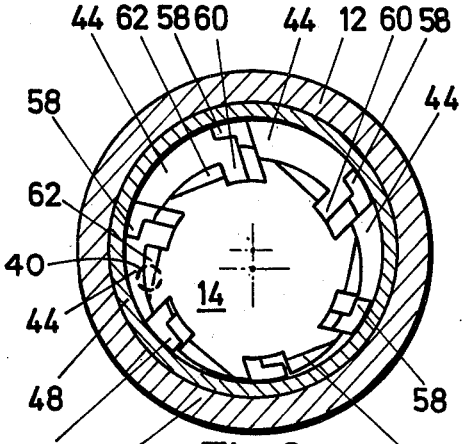
FIG. 2 is a sectional view taken along line II—II of FIG. 1.

A driving machine 10 with a cylindric casing 12 consists of a cylindric rotor 14 being arranged in a hollow cylindric recess 16 of the casing 12. The rotor 14 has guide slits 18 being uniformly distributed over the circumference. As regards the driving machine shown in FIGS. 1 to 4, the rotor 14 has six guide slits. The guide slits 18 extending radially outward have a rectangular section and run parallelly to the center axis 20 of the rotor 14. The rotor 14, at one of its ends, continues in a shaftlike tapering 22 on which a roller bearing 24 is mounted. The outer ring (not shown in any more detail) of the roller bearing 24 is arranged in a bore 25 of the rear front wall 26 of the casing 12. As a fixing medium for the outer ring serve a projection 28 in the bore 25 and a ringnut 30 being mounted in a threaded hole (not specified any further) of the front wall 26. The cylindric rotor 14 is thus overhung-mounted via the shaftlike tapering 22 in the front wall 26. The shaftlike tapering 22 with its end 32, is projecting from the front wall 26 into the space outside of the casing 12. A coupling 34 is fixed on the end 32. To the coupling 34 there is connected e.g. a dental instrument, which is not specificly shown.

The rotor 14 being pivoted in the front wall 26, is eccentrically arranged in the hollow cylindric recess 16. In the guide slits 18, segments 36 are slidingly supported. As a second front wall of the casing 12 there is provided a cover 38 being fixed on the casing 12 by means of screws (not specificly shown). By the cover 38 the recess 16 is sealed. In the cover 38 provision is made for an inlet channel 40 for the operating means and an outlet channel 42. The operating means, being admitted to the inlet channel 40 under pressure, puts the rotor 14 into rotation via the segments 36, and escapes from the casing 12 via the outlet channel 42. By the eccentric arrangement of the rotor 14 in the recess 16, a crescent-shaped working space 44 is obtained. In a section 46 of the recess 16, the distance between the circumference of the rotor 14 and the inner wall is the smallest. The openings of the inlet channel 40 and of the outlet channel 42 are arranged each on one side at or near to the section 46 in the cover 38.

Within the recess 16 there is also pivoted a cylindric box 48, of which the center axis is checking with the center axis of the recess 16. The box 48 is open toward the cover 38. The eccentric arrangement of the rotor 14 is also given with respect to the box 48. The bottom 50 of the box 48 has a passage opening 52 for the shaftlike tapering 22 of the rotor 14. A cylindric section 54 projects from the bottom 50 of the box 48 on which a roller bearing 56 is mounted. The outer ring of the roller bearing 56 is fixed in a bore hole (not specificly shown) in the front wall 26.

At their outer ends, the segments 36 are provided with broad extensions 58 of which the outer surfaces are adjusted to the inner radius of the box 48. The broadened parts 58 are configured like a hammer head. Over the circumference of the cylindric rotor 14 there are provided recesses 60 serving to lodge the hammer-head shaped broad extensions 58 when the segments 36 are in their lowest position in the guide slits 18.

The opening of the inlet channel 40 facing the recess 16 is configured like a nozzle. This inlet nozzle, in the cover 38, is inclined toward the axis 20. Due to this inclination, the operating means, e.g. compressed air, being discharged from the nozzle, is directed toward the segments 36. The operating means is led to that face of the segments 36 having the hammer-head shaped broad extension, diagonally from the cover 38.

In front of each segment 36 on the circumference of the rotor 14 viewed in its sense of rotation, there exists a recess 62. Each recess 62 is bordered by an oblique area extending from the cylindric circumference of the rotor 14 to the bottom of the recess 60. This area is also inclined toward the bottom 50 of the box 48. It is ascending toward the bottom 50. Each recess 62 is exposing a larger portion of the broadsides of the segments 36 to the impact of the operating means.

The guide slits 18, on their faces facing the openings of the inlet channel 40 and the outlet channel 42, are covered by thin walls 64. The walls 64 extend each time from the bottom of the guide slit 18 to the height of the bottom of the recess 60. Thus the walls 64 are occupying only a portion of the height of the guide slit 18. The thin walls 64 constitute stops for the segments 36. Thereby it is prevented that the segments 36 can slide against the cover 38. By means of the walls 64 a specified distance between the narrow sides of the segments 36 and the inner surface of the cover 38 can be fixed. This distance can be rather short in order to keep the flow of operating means in the slit between the narrow side of the respective segment 36 and the inner surface as low as possible. This slit is even more reduced in size as the segments 36, on their portions projecting beyond the walls 64, do have projections of the same thickness as the walls 64. In view of the fact that the walls 64 only cover the lower sections of the segments 36, there is still sufficient working surface available on the segments for the operating means.

The outlet channel 42 is connected to an oblong groove 66 arranged on the inner surface of the cover 38, the length of which being such that at least two adjacent chambers, partitioned off by segments, of the crescent-shaped operating space 44 are connected to the channel 42 at the same time. In this manner the operating means can be discharged from the chambers more easily. The discharge channel 42 can empty directly into the ambient atmosphere if compressed air is used as operating means. Thereby one can save return lines for the compressed air. Thus the expense for lines connecting the driving machine 10 is rather little.

Figure 3:
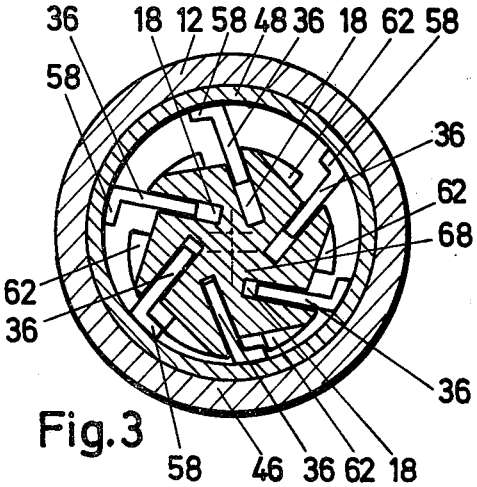
FIG. 3 is a sectional view taken along line III—III of FIG. 1.

The guide slits 18 are arranged in the cylindric rotor 14 in form of tangents as referred to a solid core surrounding the center axis 20, of which the outer border is marked 68 in FIG. 3. This arrangement has the advantage that deep slits 18 can be obtained without weakening the core of the rotor 14 too much. Even in the maximum traveled-out position of the segments 36 where they contact the inner surface of the box 48, the ends of the segments 36 facing the axis 20 are still so deep in the guide slits 18 that a good support is guaranteed even when heavy forces are transmitted to the working surfaces.

The operating means, e.g. compressed air, at 6 atm. reaches the inlet channel 40 of the cover 38 via a feed line not specificly shown. The compressed air, of which the kinetic energy is increased in the nozzle-like section of channel 40 that faces the cavity 16, flows into the crescent-shaped working space 44, in which the segments 36 are arranged in a radially sliding manner. At the outset of the start of the rotor 14, the segments 36 are still retractedly arranged in the guide slits 18. Then the compressed air is applied via the recesses 62 on the enlarged parts 58 of the segments 36. Thereby the rotor 14 is put into rotation. Under the influence of the centrifugal forces, the segments 36 slide out of the slits 18 until their enlarged parts 58 lean against the inner surface of the box 48. Thereby the segments 36 form chambers with the walls of the box 48, the inner surface of the cover 38 and the outer surface of the cylindric rotor 14 in the crescent-shaped working space 44, to which chambers compressed air is admitted when passing the opening of the inlet channel 40. By the expansion of the operating means in the chamber and its kinetic energy, forces are exerted on the segments 36 which are transmitted to the cylindric rotor 14 and being available at the coupling 34. When the chambers pass the groove 66, the pressurized gas leaves the chambers via the groove 66 and the discharge opening 42. Thereby the pressure of the ambient atmosphere is again developed in the chambers.

At increasing speed of the rotor 14, due to the rising centrifugal forces in the segments 36, the pressure between the outer surfaces of the enlarged parts 58 and the inner surface of the box becomes higher. Thereby the enlarged parts 58 stick to the inner surface of the box 48 so that the latter will rotate together with the segments 36. For this reason there is no friction between the outer surfaces of the enlarged parts 58 and the cylindric inner surface of the box 48. During the rotations, the segments 36 are merely making shifting motions in radial direction. Depending on how closely the rear narrow sides of the segments 36 get to the bottom 50 of the box 48, it could be that thereby, too, frictional forces will have to be overcome. These are, however, insignificant. The segments 36 resting against the cylindric inner surface of the box 48 secure a good sealing between the chambers. Therefore the percentage of compressed air that can flow through by-ways past the segments 36 to the discharge channel 42, is rather low. Thus the driving machine 10 possesses high efficiency.

It has become evident that with the driving machine 10 it is possible without any difficulty to get speeds of 20,000 rotations per minute at a pressure of 6 atms. of compressed air. This speed corresponds to that of turbines with blade wheel systems for the drive of dental instruments. However, contrary to the turbine blades, the rotor 14 has only level or cylindric surfaces. This also applies to the segments 36. As the other parts of the driving machine 10 are likewise of simple constructive configuration, the machine 10 can be economically manufactured. At small dimensions and little weight, the driving machine 10 delivers high powers to the coupling 34.

On the bottom of the guide slits 18 springs can be arranged in a manner not specifically shown, by which the segments are constantly pressed against the inner surface of the box 48. It is also possible to put up the driving machine 10 with the section 46 on top and the crescent-shaped working space 44 at the bottom. Thereby the segments 36 are resting against the inner surface of the box 48 under the influence of their weight. If the segments 36 contact the inner surface of the box 48 already in initial position, the starting time of the rotor 14 is reduced.

After switching off the compressed air supply, the rotor 14 comes to a stillstand in a short time already. This is furthered by the frictional forces resulting during the relative motion between the segments 36 and the inner surfaces of the slits 18 as well as between the rear narrow sides of the segments 36 and the bottom 50 of the box 48. Since with decreasing speed also the centrifugal forces acting on the segments 36 will lessen, relative motions will result due to the abating pressure between the enlarged parts 58 and the cylindric inner surface of the box, which motions because of the friction, will consume the kinetic energy of the rotor 14 and the segments 36 and cause a quick braking. A portion of the kinetic energy is also consumed by the compression and expansion of air taking place in the chambers during rotation of the rotor after the compressed air supply has been switched off.

Since the slow-down time of the rotor 14 is rather short, the driving machine will be quickly ready for changing the dental instrument after the supply of operating means has been switched off. By using the driving machine 10, a considerable reduction of the time for treatment can be achieved, especially when instruments are changed very often. The driving machine 10 can be used not only for dental instruments, e.g. drills, but also for other consumers of mechanic work if dimensioned accordingly. It is possible to connect drills, grinding and polishing disks, either directly or via a flexible shaft, to the end 32.

Figure 5:
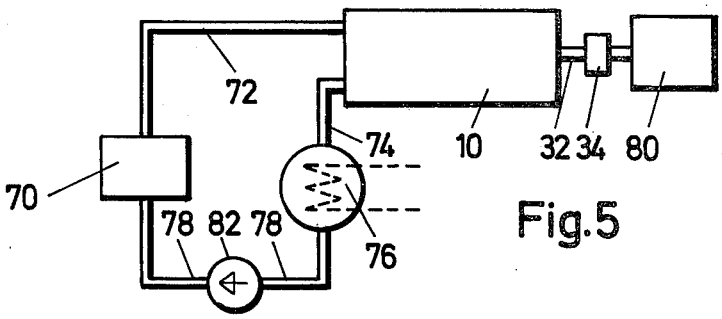
FIG. 5 is a schematic block diagram by arranging the new machine in the cycle of an operating means.
Figure 6:
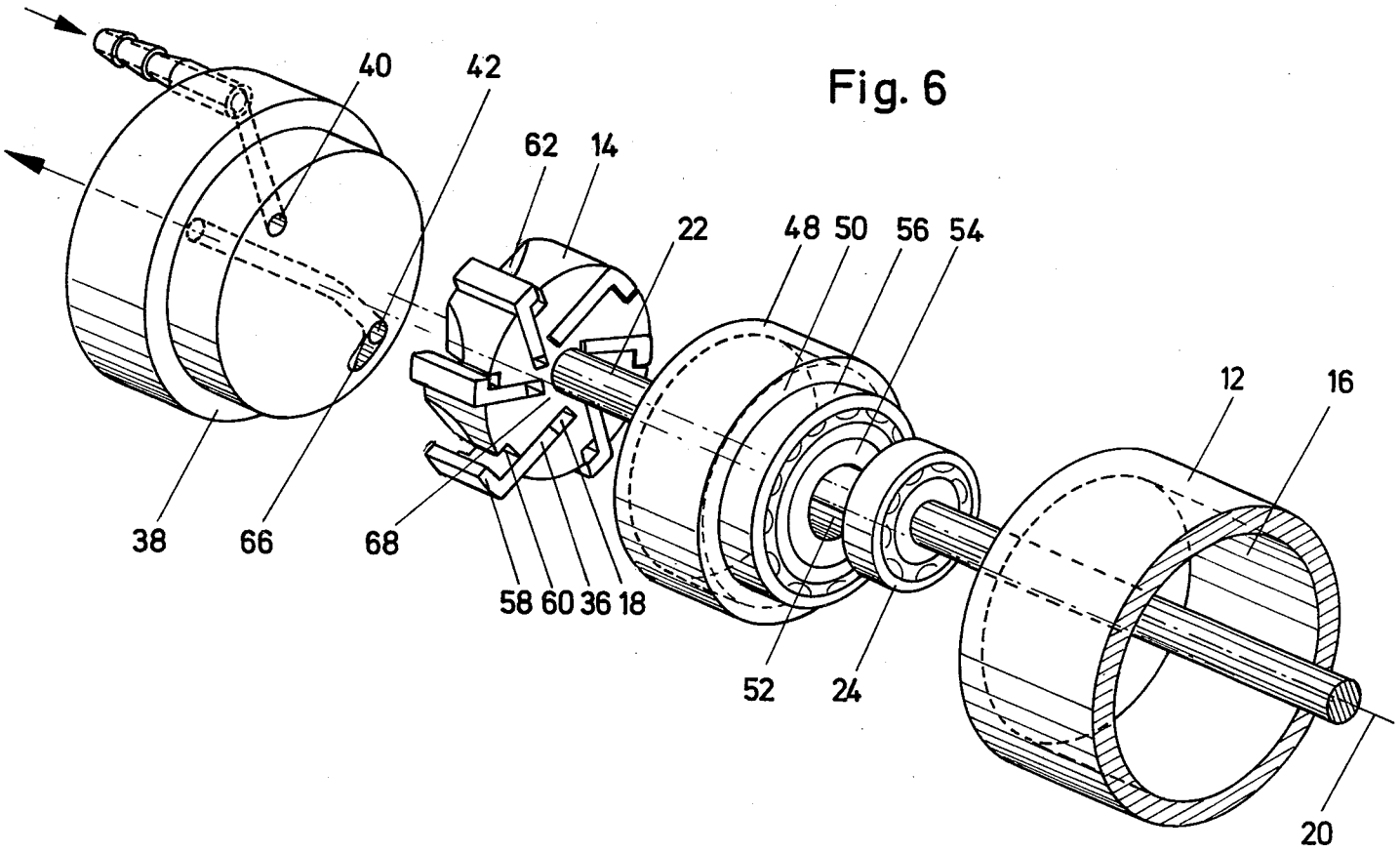
FIG. 6 is a schematic perspective view of the components drawn asunder.

Concerning the device as shown in FIG. 5, the driving machine 10 is incorporated in a complete cycle of operating means. In this cycle, a liquid is used with a low boiling point. In a vessel this liquid is changed into the gas phase by supplying heat, whereby an increased pressure is produced. Under high pressure, the gas flows into the driving machine via a line 72 and puts the rotor 14 into rotation. In the driving machine 10 the gas works in the above described manner and is cooling down thereby under fall of pressure. From the discharge channel 42 via a line 74, the gas flows into a heat exchanger 76 in which it is reliquefied. By means of a pump 82 arranged in a line 78, the liquid is subsequently led to the vessel 70. To the coupling 34 of the driving machine 10 there is connected e.g. an electric generator 80. The device according to FIG. 5 can also be used to drive a vehicle.

If the rotor 14 is of longer design, it is practical to additionally support the box 48 at its side adjacent to the cover. The additional bearing receives the forces emanating from the frontal portion of the rotor 14 and the box 48.

I claim:

1. A drive apparatus utilizing a fluid pressure driven rotor; said apparatus comprising a casing having first and second end walls, a hollow cylindrical chamber defined within said casing between said end walls, a hollow cylindrical box rotatably positioned within said chamber, a cylindrical rotor of smaller diameter than said box and positioned eccentrically within said box, said cylindrical box being coaxial with said chamber and closely conforming thereto, said box having an open end adjacent the second end wall of the casing for communication of the fluid inlet and fluid outlet means with the interior thereof, a projecting shaft fixed axially to said rotor, said shaft being rotatably mounted in said first end wall and mounting said rotor for rotation within said chamber and said box, said rotor having a plurality of generally radial guide slots defined longitudinally therein and at spaced points thereabout, a segment slidably positioned in each slot for a selective generally radial extension and retraction of each segment relative to the eccentrically positioned rotor upon a rotation thereof, said segments, upon extension thereof from the respective slots, engaging the inner surface of said box for selective rotation of the box with the rotor, the segments each including opposed generally flat side faces and an enlarged portion at their outer ends having an outer surface conforming to the inner surface of the hollow cylindrical box, the eccentric positioning of the rotor placing the rotor near to one side of the chamber and defining a crescent-shaped working space about the rotor in the remainder of the chamber, said crescent-shaped working space having opposed ends, fluid inlet means through the second end wall communicating with the crescent-shaped working space toward one end thereof for the introduction of a pressurized fluid, said fluid inlet means having a nozzle configuration and being oriented to direct introduced fluid against the same side face of each of the segments serially to effect a rotation of the rotor in one direction, and fluid outlet means through the second end wall communicating with the crescent-shaped working space toward the second end thereof.

2. The drive apparatus of claim 1 wherein a recess is defined in the rotor in communication with each segment slot to the side thereof corresponding to the side face of the associated segment against which introduced fluid is to be directed, whereby an outer marginal section of each segment remains accessible to the introduced fluid in even the retracted position of the segment within the slot.

3. The drive apparatus of claim 1 wherein each segment has opposed side faces, said fluid inlet means being oriented to direct introduced fluid against the same face of each of the segments to effect a rotation of the rotor in one direction, and a recess defined in the rotor in communication with each segment slot to the side thereof corresponding to the side face of the associated segment against which introduced fluid is to be directed, whereby an outer marginal section of each segment remains accessible to the introduced fluid in even the retracted position of the segment within the slot.

4. The drive apparatus of claim 1 wherein six slots and associated segments are priovided at equally spaced points about the rotor.

5. The drive apparatus of claim 1 wherein the rotor, at an end thereof corresponding to the second end wall of the casing, has the slots therein partially closed by thin walls which extend outward from the inner ends of the slots.

6. The drive apparatus of claim 1 wherein the segments, when extended, divide the working space into chamber sections, said fluid outlet means communicating with two adjacent chamber sections.

7. The drive apparatus of claim 1 wherein the rotor includes a solid core, said slots being arranged tangentially to the core.

8. The drive apparatus of claim 1 including a closed circuit fluid pressurizing means interconnecting said outlet means and said inlet means, said closed circuit fluid pressurizing means including a low boiling point liquid, and heat supplying means for vaporizing the liquid.

* * * * *